US009458611B2

(12) United States Patent
Abbing

(10) Patent No.: US 9,458,611 B2
(45) Date of Patent: Oct. 4, 2016

(54) METHOD AND A LIQUID DISTRIBUTION SYSTEM FOR RETAINING THE TEMPERATURE OF A LIQUID IN THE SYSTEM

(75) Inventor: Erik Abbing, Lulea (SE)
(73) Assignee: 3EFLOW AB, Lulea (SE)

( * ) Notice: Subject to any disclaimer, the term of this patent is extended or adjusted under 35 U.S.C. 154(b) by 326 days.

(21) Appl. No.: 14/113,407
(22) PCT Filed: Apr. 27, 2012

(86) PCT No.: PCT/SE2012/050445
§ 371 (c)(1),
(2), (4) Date: Dec. 5, 2013

(87) PCT Pub. No.: WO2012/148351
PCT Pub. Date: Nov. 1, 2012

(65) Prior Publication Data
US 2014/0202543 A1 Jul. 24, 2014

(30) Foreign Application Priority Data
Apr. 28, 2011 (SE) ..... 1150372

(51) Int. Cl.
*E03C 1/04* (2006.01)
*E03B 7/04* (2006.01)
(Continued)

(52) U.S. Cl.
CPC ..... *E03C 1/04* (2013.01); *E03B 7/045* (2013.01); *E03B 7/09* (2013.01); *F24D 17/0031* (2013.01);
(Continued)

(58) Field of Classification Search
CPC ..... E03C 1/04; E03B 7/04; E03B 7/045; E03B 7/09; E03B 1/04; E03B 1/048; F24D 17/00; F24D 17/0031; F24D 17/0078; F24D 17/0084; F24D 19/1051; F16K 15/145; F16K 15/147; Y10T 137/0318; Y10T 137/86879
USPC ..... 137/1, 12, 13, 14, 171, 173, 175, 177, 137/183, 184, 197, 198, 199, 206, 207.5, 137/213, 843, 844, 845, 846, 847, 848, 852, 137/855, 859, 860
See application file for complete search history.

(56) References Cited

U.S. PATENT DOCUMENTS 2,823,694 A * 2/1958 Champion ..... F16K 17/00 137/197
4,084,606 A * 4/1978 Mittleman ..... A61M 5/00 137/102
(Continued)

FOREIGN PATENT DOCUMENTS

DE 4406150 9/1995
FR 2982623 A1 * 5/2013 ..... E03B 7/045
(Continued)

OTHER PUBLICATIONS

Machine Translation for FR 2982623 A1.*
(Continued)

*Primary Examiner* — Kevin Murphy
*Assistant Examiner* — Ian Paquette
(74) *Attorney, Agent, or Firm* — Young & Thompson

(57) ABSTRACT

A method and a fluid tap device for retaining the temperature of a liquid, in a liquid distribution system having at least one liquid conduit extending from a liquid source to a liquid tap. After completion of a tapping operation and replacing the liquid with gas in the conduit, the refilling of liquid in the conduit is performed in three steps:

a first step, initiated by activating the tap thereby causing a change of a physical variable which propagates backwards along the conduit and initiates a second step, the second step involving refilling the conduit with liquid from the source, while permitting remaining gas to escape via a gas passage separate from a liquid passage in the tap, and a third step, initiated when the liquid reaches the tap, involving opening the passage and permitting the liquid to flow out via the passage and through the tap.

18 Claims, 7 Drawing Sheets

(51) Int. Cl.
*E03B 7/09* (2006.01)
*F24D 17/00* (2006.01)
*F24D 19/10* (2006.01)

(52) U.S. Cl.
CPC ..... *F24D 17/0078* (2013.01); *F24D 19/1051* (2013.01); *Y10T 137/0318* (2015.04); *Y10T 137/86879* (2015.04)

(56) References Cited

U.S. PATENT DOCUMENTS 4,930,551 A * 6/1990 Haws ..... F24D 17/00 122/13.3
6,453,940 B1 * 9/2002 Tipton ..... F04B 53/1092 137/493.9
2003/0019530 A1 1/2003 Nutsos
2012/0118414 A1 * 5/2012 McMurtry ..... E03B 1/048 137/605
2012/0266961 A1 * 10/2012 Holmes ..... E03B 7/045 137/1
2013/0228233 A1 * 9/2013 Haws ..... G05D 23/1306 137/337
2014/0060660 A1 * 3/2014 Lebkuchner ..... E03B 7/045 137/2

FOREIGN PATENT DOCUMENTS

WO 2005116497 12/2005
WO 2010/103521 9/2010

OTHER PUBLICATIONS

Machine Translation for DE 4406150 A1.*

International Search Report dated Aug. 2, 2012, corresponding to PCT/SE2012/050445.

* cited by examiner

METHOD AND A LIQUID DISTRIBUTION SYSTEM FOR RETAINING THE TEMPERATURE OF A LIQUID IN THE SYSTEM

FIELD OF THE INVENTION

The present invention relates to a method and a liquid distribution system for retaining the temperature of a liquid in the system having at least one liquid conduit extending from a liquid source to a liquid tap, said method comprising the steps of evacuating the liquid from the liquid conduit after completion of a tapping operation and a possible short delay, by generating a backward pressure gradient in said liquid conduit, causing the liquid to flow backwards towards said liquid source, while letting a gas flow into the liquid conduit and replace the backwardly flowing liquid therein, stopping said backward flow of liquid when the liquid conduit is evacuated, and evacuating the gas from the liquid conduit when liquid is to be tapped again from said liquid tap, by generating a forward pressure gradient in said liquid conduit causing the liquid to flow from said liquid source to said liquid tap.

BACKGROUND OF THE INVENTION AND PRIOR ART

Such a method is disclosed in Applicant's international patent application PCT/SE2010/051172, filed 28 Oct. 2010, (priority date 30 Oct. 2009). A similar method is also previously known from the German published specification (Offenlegungsschrift) DE 4406150 A1 (Pumpe et al). In this prior art system for hot water distribution in a building, there is a pressure sensor 10 in a liquid chamber adjacent to the warm water tap. When tapping water, an electric signal is fed back through an electric line 11 to a centrally located control device 19. Accordingly, there is a need for separate electric cables being drawn from each hot water tap to the central control device.

Another major drawback with this known method is that, in order to avoid a high pressure peak and strong noise when the liquid (the hot water) reaches the liquid tap during a refilling operation, an air injector (17) has to be used so as to make the hot water liquid "elastic".

OBJECT OF THE INVENTION

Against this background, a main object of the present invention is to provide a simpler method and system, where there is no need for an air injector making the liquid "elastic".

Another object is to provide a method and device, which will not necessitate separate electric cables between the various liquid taps and the central liquid source.

A further object is to provide a valve device which will ensure that, when the liquid is pumped back from the liquid source to the liquid tap, gas or air will be permitted to escape through a separate gas passage up to the moment when the liquid reaches the liquid tap.

SUMMARY OF THE INVENTION

In order to achieve these objects, the present invention provides an improved method, wherein the step of evacuating the gas from the liquid conduit and refilling of liquid in the liquid conduit is performed in three steps:

a first step, initiated by said liquid tap being activated, the activation of the liquid tap causing a change of a physical variable said change being sensed by a sensor so as to initiate a second step, said second step involving refilling the liquid conduit with liquid from said liquid source, while permitting remaining gas to escape via a gas passage being separate from a liquid passage in said liquid tap, and a third step, initiated when the liquid reaches said liquid tap, involving opening said liquid passage so as to permit the liquid to flow out via said liquid passage and through said liquid tap, and the method is characterized in that, at the end of said second step of refilling the liquid conduit with liquid from said liquid source, the motion of liquid will be damped, when it approaches said at least one separate gas passage, by means of a compressible volume of gas communicating with said at least one separate gas passage.

Furthermore, the invention also relates to a fluid distribution system, designed for carrying out this method and provided with a liquid tap and a valve device connected to a liquid conduit extending from a source of liquid, said valve device comprising a liquid valve unit for the passage of liquid through a liquid passage from said liquid conduit to said liquid tap, and a gas valve unit being arranged in proximity to said liquid valve unit for feeding gas into said liquid conduit in order to replace liquid with gas in said liquid conduit when the liquid tap is not in use, said gas valve unit (110, 116) comprising at least one separate gas passage (113) which is separate from said liquid passage (112), said gas valve unit (110, 116) serving both as a gas inlet valve and as a gas outlet valve, said at least one separate gas passage (113) being used both for feeding gas into the liquid conduit (7) after closing the liquid tap (9) and for letting gas escape from the liquid conduit when refilling the liquid conduit with liquid from said liquid source upon activating the liquid tap, and said valve device being adapted to enable said refilling of the liquid in three steps:

a first step, initiated by said liquid tap (9) being activated, the activation of the liquid tap causing a change of a physical variable said change being sensed by a sensor so as to initiate a second step, said second step involving the generation of said forward pressure gradient and refilling the liquid conduit with liquid from said liquid source, while permitting remaining gas to escape via said at least one separate gas passage (113), and a third step, initiated by said liquid reaching said gas valve unit (110, 116), involving opening said liquid passage so as to permit liquid to flow out via said liquid passage (118, 112) and through said liquid tap (9);

the liquid distribution system being characterized in that a damping device (400), including a compressible volume, is located adjacent to the gas valve unit, whereby the motion of liquid will be dampened when it approaches the valve device during a filling operation.

According to a further preferred feature of the present invention, the sensor is centrally located. Then, the liquid conduit itself is used for feeding a change of a physical variable along the liquid conduit. Thus, such a change or signal will propagate back to the source of liquid, where it will initiate the two further steps of the re-filling operation.

The physical variable may be a static pressure, but it may also be a dynamic variable, such as a pressure pulse or some other alternating pressure change or a sound signal through the gas in the conduit, or it may be an electric signal being transmitted in or along the walls of the conduit. The walls of the conduit may be made of an electrically conducting material, such as a metal or an electrically conducting coating on the conduit wall. A switch connected to the conduit wall, or an electrically conducting layer or wire incorporated in or disposed on the conduit wall, may be activated so as to trigger an electric signal which will propagate along the liquid conduit.

In any case, there will be no need for any separate wiring or cables for the feedback of a signal indicating that a tapping operation is to be initiated.

In this regard, a change of the static pressure in the liquid conduit is easy to achieve, for example by opening a gas or air valve so that the gas or air pressure in the liquid conduit increases and will approach the pressure of the ambient air.

The activation of the liquid tap, when a tapping operation is to be initiated, can be achieved by a regular handle, but it may alternatively be achieved by a proximity or touch sensor which detects the presence of an arm or a hand of a person in the vicinity of the liquid tap.

Further advantageous features of the invention will be apparent from the description below, and from the appended claims, in particularly in respect of preferred embodiments of a liquid distribution system according to the invention.

BRIEF DESCRIPTION OF THE DRAWINGS

The invention will now be explained further below, with reference to the appended drawings which illustrate preferred embodiments of a liquid tap device according to the invention.

DETAILED DESCRIPTION OF SOME PREFERRED EMBODIMENTS

In the description below, the liquid distribution system is intended for water. However, those skilled in the art will realize that the system may alternatively be intended for any other liquid. Furthermore, the system is designed for hot water. Similarly, the system may alternatively be used for the distribution of cold water or some other cold liquid.

Figure 1:
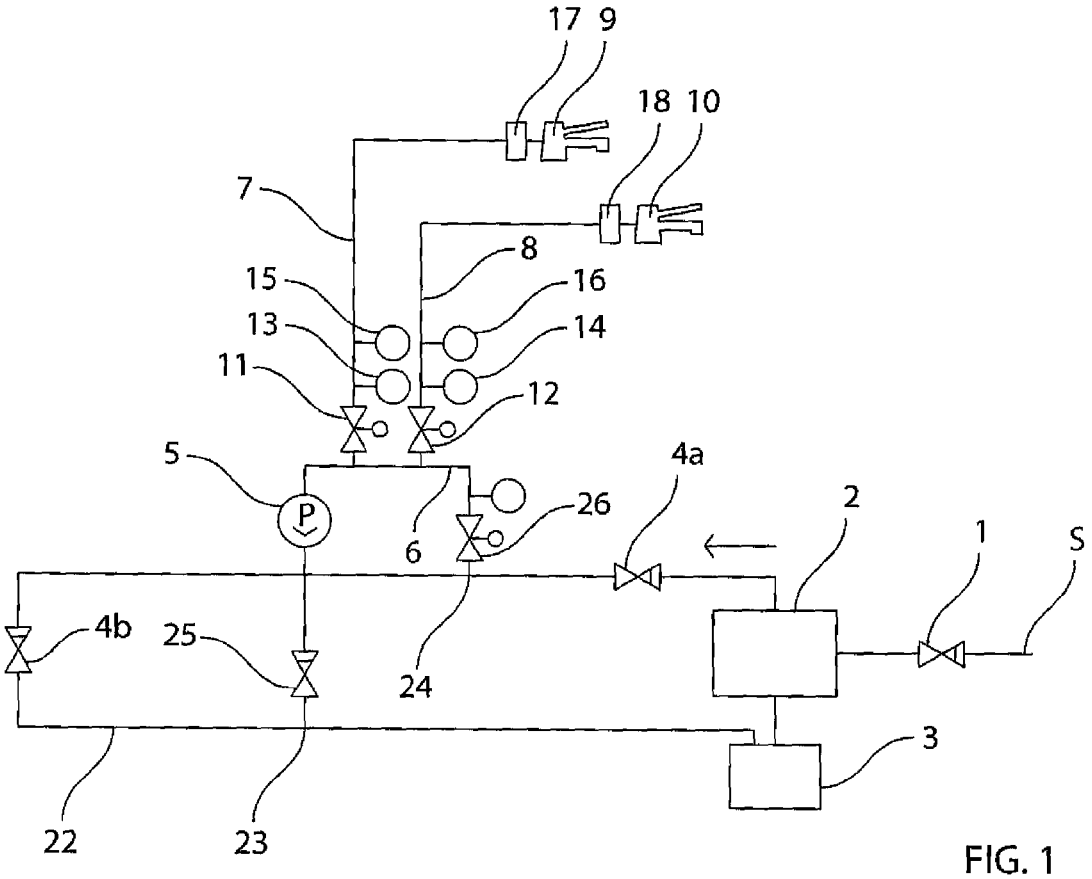
FIG. 1 illustrates schematically a liquid distribution system as disclosed in the above mentioned international patent application PCT/SE2010/051172.

The water distribution system shown in FIG. 1 is identical to one of the embodiments disclosed in the above mentioned international patent application PCT/SE2010/051172. However, as will be apparent below, the improvement provided by the present invention resides in an improved function and structural embodiment of a valve device 17, 18 arranged in a liquid tap device 9 or 10, respectively.

In the system of FIG. 1, water is supplied from a source S of fresh water, e.g. a public water supply line or a local water supply, via a non-return valve 1 to a hot water tank 2, where the water is heated to a relatively high temperature, typically in the interval 60-90° C. There is a re-circulating loop 22 of hot water passing through the water heater 2 and a hydro-pressure vessel 3 serving to accommodate a variable volume of air or gas. The hot water is circulated by means of a circulation pump (not shown) adjacent to the heater 2, and two further non-return valves 4*a*, 4*b* will ensure that the circulation is maintained in one direction only. Moreover, there is a hot water feed line 6 bridging the loop 22 at two points 24 and 23. In the hot water feed line 6, there is a pump 5, which will be activated only in case all hot water conduits 7, 8, leading to various hot water taps in a building, are passive or closed.

In each hot water conduit 7, 8, there is a control valve 11 and 12, respectively, which can be opened or closed, a level sensor 13 and 14, respectively, and a pressure sensor 15 and 16, respectively. All these components are located centrally, near the hot water source, together with the hot water tank 2 and the circulating loop 22 with its bridging line 6. In the hot water bridging line 6 there is also a non-return valve 25 and a control valve 26.

The hot water tank 2, the re-circulating loop 22 and the bridging hot water line 6 may be regarded as a heat source or hot water source, since the circulating water is always kept at an elevated temperature and will continuously supply hot water to the hot water conduits 7, 8. If necessary, the hot water source may be contained in an insulated enclosure, or the components may be individually covered by an insulating material.

As described in the above mentioned PCT application, hot water will only be present in the liquid conduits 7, 8 when hot water is being tapped from the respective tap 9 and 10. When the tap 9, 10 is closed, possibly after a short delay (e.g. a few minutes) which does not significantly affect the temperature of the hot water in the conduit, the hot water remaining in the respective conduit will be pumped out in the backward direction by means of the pump 5, back to the hot water source 2, 22. In this process the hot water will be replaced by air or gas in the liquid conduit 7, 8. When the hot water has been evacuated, the respective valve 11, 12 will be closed, and a low gas or air pressure, clearly below the ambient atmospheric air pressure, will remain in the conduit 7, 8.

When hot water is going to be tapped again from the tap 9 or 10, a refilling operation will be initiated. For this purpose, the present invention provides for an improved re-filling operation as will now be described in detail.

When the tap 9 or 10 is activated, e.g. by moving the associated handle, or by a remote or touch sensor at the tap, the associated valve device 17, 18 will bring about a change of a physical variable, and this change or signal will preferably propagate along the liquid conduit 7, 8 all the way to a centrally located sensor, such as the pressure sensor 15, 16 or some other sensor which detects the change or signal. Thereupon, a second step will be initiated so as to open the valve 11 or 12, respectively, whereby hot water will flow in the forward direction along the liquid conduit 7, 8 all the way to the valve device located in the vicinity of the tap 9, 10. When the water reaches an air or gas valve unit, the air or gas valve will close (unless the air valve unit forms part of a closed gas system), and a separate passage for liquid in an adjacent liquid valve will open so as to let through the hot water through the tap 9, 10.

In some of the embodiments to be described below, the physical variable being changed by activating the hot water tap, will be the static pressure of the gas or air inside the air valve unit or a pressure pulse generated by the activation of the water tap, or an electric voltage or current. This will be understood from the description below of some embodiments of the fluid tap device according to the invention.

Figure 2A:
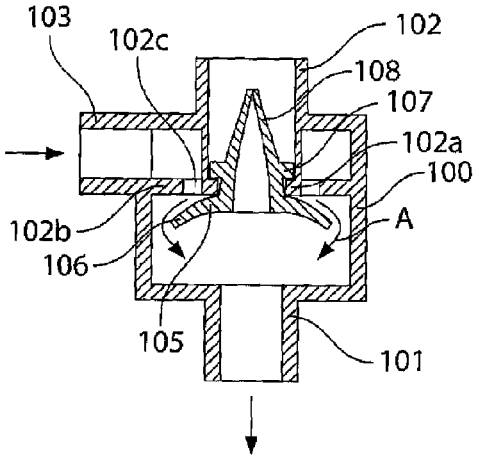
FIG. 2a PRIOR ART
FIGS. 2*a* and 2*b* show a prior art valve device.
Figure 2B:
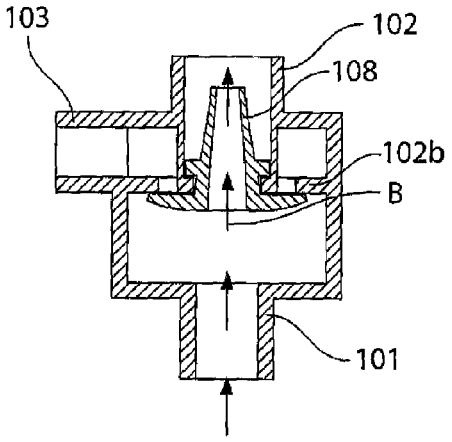
FIG. 2b PRIOR ART
Figure 3A:
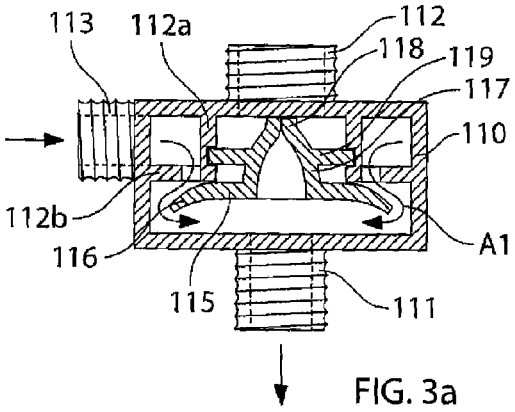
FIGS. 3*a*, 3*b*, 3*c* illustrate a preferred embodiment of a valve device in a liquid tap device according to the present invention, in three different modes of operation.
Figure 3B:
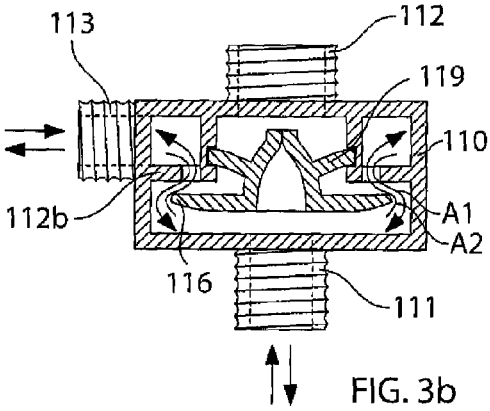
Figure 3C:
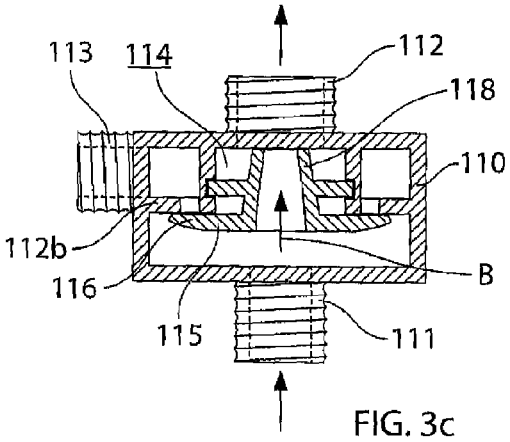

A preferred valve device, in a liquid tap device, is illustrated in FIGS. 3*a*, 3*b* and 3*c*, this embodiment being a device developed from a prior art valve device illustrated in FIGS. 2*a* and 2*b*.

In the prior art valve device shown in FIGS. 2*a* and 2*b* (known per se, but not in a system like the one shown in FIG. 1), there is a valve housing 100 with three pipe connections, namely one pipe connection 101 to be connected to a liquid conduit, an opposite pipe connection 102 to be connected to a liquid tap and a pipe connection 103 to be connected separately to the ambient air. Centrally in a cylindrical passage between the pipe connections 101 and 102, there is mounted a valve body 105 of a relatively stiff but flexible material. The valve body 105 comprises a central, tubular portion 107 which is firmly held in an annular flange 102*a* at the inner end portion of the pipe connection 102. The valve body 105 also includes an upper portion 108 forming a so called duck-bill check valve for the liquid to be passed through to the liquid tap and, at the other axial end, a radially outwardly extending ring or annular portion 106 forming an umbrella type valve cooperating with a valve seat 102*b* having a number of holes or air or gas passages 102*c* communicating with the pipe connection 103. When the air (or gas) pressure in the pipe connection 103 is higher than the air (or gas) pressure in the pipe connection 101, there will be a flow of air (or gas) through the air or gas passages 102*c* and passing around the ring portion of the umbrella valve 106, as indicated by the arrows A in FIG. 2*a*.

On the other hand, when the pressure in the pipe connection 101 is higher than the pressure in the pipe connection 103, the umbrella valve 106 will close against the seat 102*b*, and any liquid flowing through the pipe connection 101 will cause the duck-bill valve 108 to open and let through the liquid to the pipe connection 102. Thus, the prior art valve device will operate as an inlet valve for air in one direction (FIG. 2*a*) and as a release valve for liquid in the other direction (FIG. 2*b*).

Now, according to the present invention, a new kind of valve device is illustrated in FIGS. 3*a*, 3*b* and 3*c*. The modified valve device comprises a valve body 115 having an umbrella valve 116 and a central tubular part 117 with a duck-bill valve 118 at the end portion adjacent to the pipe connection 112. Importantly, the valve body 115 also has a flexible diaphragm 119, the radially outer end portion of which is firmly secured to the central tubular part 112*a* of the valve device communicating with the pipe connection 112. Thus, the flexible diaphragm 119 serves as a holding portion, and the valve body 115 is held by the diaphragm in such a way that it is axially movable between two different axial positions, a first axial position, FIGS. 3*a* and 3*c*, where the umbrella portion 116 abuts the air valve seat 116 and serves as a check valve part by flexing away from the air valve seat (FIG. 3*a*), and a second position (FIG. 3*b*), where the umbrella portion 116 is located at a distance from the air valve seat 112*b*, so as to permit an air flow in both directions (arrows A1 and A2) and to serve also as an air release valve part (arrow A2). Accordingly, FIG. 3*b* illustrates a novel feature of the valve device, as compared to the prior art valve device, the air being permitted to flow in both directions, and the air valve unit now serving both as an air inlet valve and as an air release valve.

In the position shown in FIG. 3*c*, the valve device corresponds to the prior art valve device in FIG. 2*b*, permitting liquid to flow through the pipe connection 111 and centrally through the duck-bill valve part 118 and out through the pipe connection 112, which forms a liquid passage. In this position, the umbrella valve part 116 is closed provided that the pressure in the pipe connection 111 is higher than or substantially equal to the pressure in the pipe connection 113.

The new valve device 110, 115 will operate as follows, as illustrated in FIGS. 4*a*, 4*b*, 4*c*, 4*d* and 4*e*.

Figure 4A:
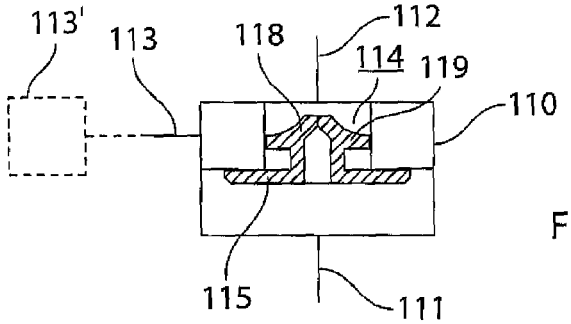
FIGS. 4*a*, 4*b*, 4*c*, 4*d*, 4*e* illustrate schematically how the valve device according to FIGS. 3*a*-3*c* works.

FIG. 4*a* illustrates the situation (compare FIG. 1) where the hot water tap 9 or 10 has just been closed. At this time, the water pressure in the chamber 114 between the diaphragm 119 and the pipe section 112 (the liquid passage communicating with the tap) will increase to a level which causes the duck-bill valve 118 to close, as shown. Of course, when the tap 9 or 10 is closed and stops the flowing water, the water pressure will increase also at the other side of the valve body 115 and in the water conduit 7, 8 connected to the pipe connection 111. The increase of the water pressure or a pressure pulse will immediately propagate backwards through the conduit 7, 8 to the associated pressure sensor 15 or 16. When this happens, possibly after a short delay, the valve 11, 12 will be opened, and the pump 5 will be activated so that hot water is being pumped backwards through the water conduit 7, 8 to the hot water source 2, 22. During this process, the pressure in the water conduit 7, 8 will decrease rapidly. In turn, this will cause the umbrella valve part 116 to flex away from the valve seat 112*b*, thereby letting ambient air or gas flow (possibly from a closed gas system 113' indicated in FIG. 4*a*) through the air or gas passages 112*c* in the valve housing 110. The backwardly flowing air or gas (arrow A1 in FIGS. 4*b* and 4*d*) will replace the hot water in the water conduit 7, 8.

When the level sensor 13, 14 senses that the water conduit 7, 8 has been totally evacuated from water, the valve 11, 12 will be closed and the pump 5 is stopped. The valve body 115 in the valve device will remain in its upper, first position, because hot water, which is incompressible, will remain in the chamber 114, being trapped by the duck-bill valve 118. Therefore, as illustrated in FIG. 4*c*, after a slight increase of the air or gas pressure in the conduit 7, 8, the umbrella valve part 116 will close against the seat 112*b* and will remain in this position until the associated water tap is activated.

Figure 4B:
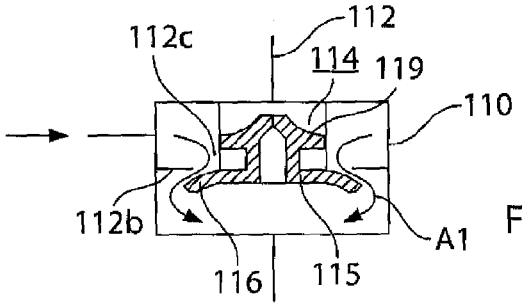
Figure 4C:
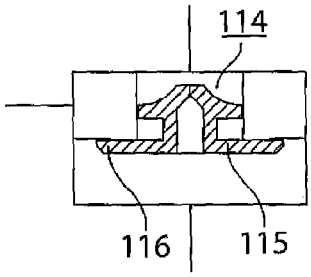
Figure 4D:
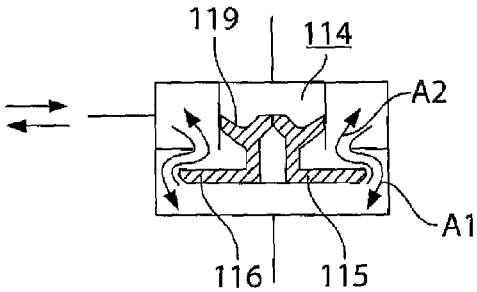
Figure 4E:
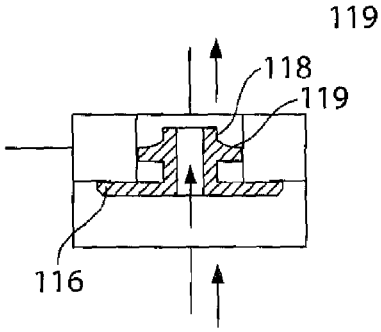

When the hot water tap is activated again (either by operating the handle or by way of a remote or touch sensor), the water volume being trapped in the chamber 114 will be exposed to ambient air pressure via the tap, and this will cause the water to flow out and release the diaphragm 119, thereby shifting the valve body 115 into the second position shown in FIG. 4*d*. At this time, the air or gas pressure in the water conduit 7, 8 is lower than the ambient air, and therefore air or gas will easily pass through the umbrella part 116 of the valve body 115 (arrow A1 in FIG. 4*d*). Accordingly, there will be a further increase of air or gas pressure or a pressure pulse in the conduit 7, 8, propagating backwards towards the hot water source. The increased air or gas pressure or pressure pulse will be sensed by the pressure sensor 15 or 16, causing the opening of the associated valve 11 or 12. Then, hot water will flow in the forward direction of the hot water conduit 7 or 8. The air or gas remaining in this conduit, being pushed forward in front of the liquid, will find its way out through the valve device, as illustrated by the arrow A2 in FIG. 4*d*. The hot water will flow rapidly through the water conduit 7, 8 and will eventually strike against the umbrella part 116 of the valve body 115. The strike will be effectively dampened, as will be explained below. When this happens, bearing in mind that the tap is open, the valve body 115 will again shift into its first position, thereby closing the umbrella valve 116. At the same time, because of the water pressure and the open tap, the duck-bill valve 118 will open and let through the hot water through the pipe connection 112 and out through the separate liquid passage to the associated tap 9 or 10, possibly via a relatively short length of pipe.

Thereafter, when the tap is closed, the valve device 110, 115 will again take the position shown in FIG. 4*a*.

The above sequence of operation illustrates the inventive structure and operation of the valve device, especially in respect of the diaphragm 119 which enables the axial positioning of the valve body 115. In particular, the position shown in FIG. 4*d* is important, allowing air or gas to pass through the air valve in both directions (A1, A2).

Figures 5A, 5B, 5C, 5D, 5E:
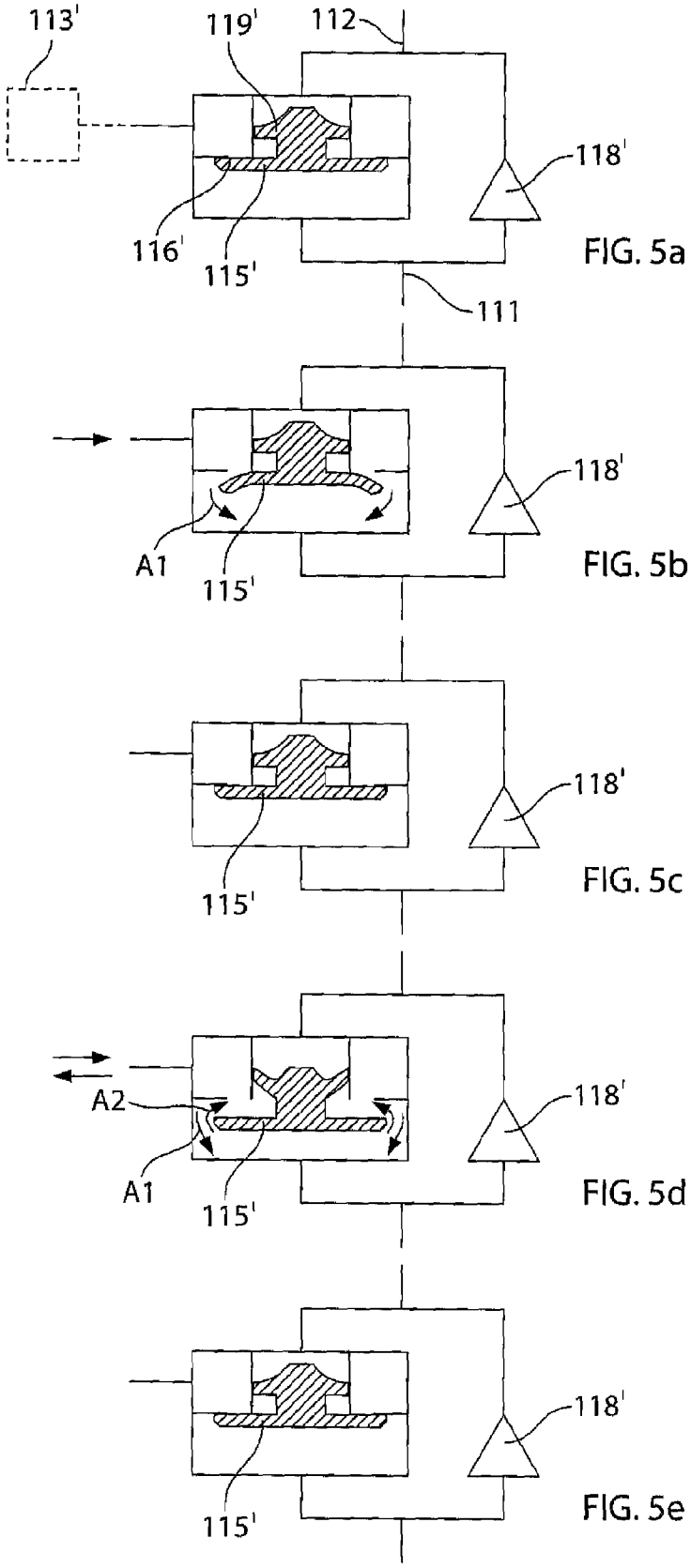
FIGS. 5*a*, 5*b*, 5*c*, 5*d*, 5*e* illustrate, in a similar manner as in FIGS. 4*a*-4*e*, how a second embodiment of a valve device operates.

The inventive valve device may be modified into different embodiments, two of which are illustrated in FIGS. 5*a*-5*e* and 6*a*-6*i*, respectively. In the second embodiment, shown in FIG. 5*a* etc., the valve body 115' is similar to the one shown in FIGS. 4*a*-4*e*, with an umbrella valve portion 116' and a diaphragm 119' permitting the valve body 115' to take either one of two positions. However, the central part of the valve body 115' is solid and has no central axial passage for water. Instead, in parallel to the valve body 115', there is a separate liquid check valve 118' permitting hot water to flow from the pipe connection 111 to the pipe connection 112. Except for this structural difference, the valve device shown in FIGS. 5*a*-5*e* operates exactly like the previous embodiment.

Figure 6A:
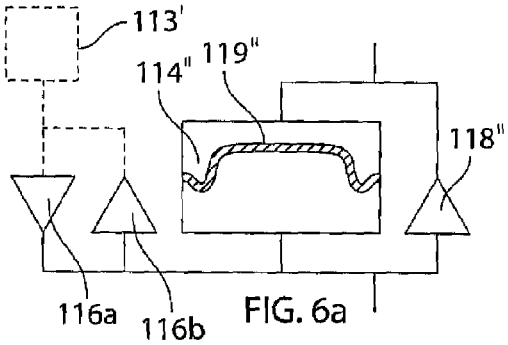
FIGS. 6*a*, 6*b*, 6*c*, 6*d*, 6*e*, 6*f*, 6*g*, 6*h*, 6*i* illustrate further embodiments of the valve device, in different modes of operation.
Figure 6B:
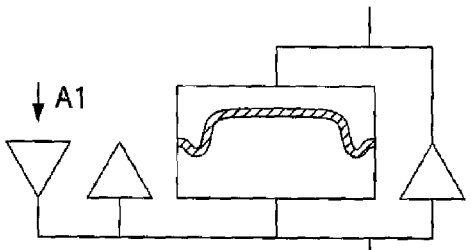

A third embodiment is illustrated in FIGS. 6*a*, 6*b*, etc. The valve body 115, 115' is replaced by a diaphragm 119", which operates in conjunction with the water contained in the water chamber 114", exactly in the same way as in the previous embodiments. The air valve unit comprises an air inlet valve part 116*a* and an air release valve part 116*b*. Also, as in the previous embodiment, there is a parallel liquid valve 118".

Figure 6C:
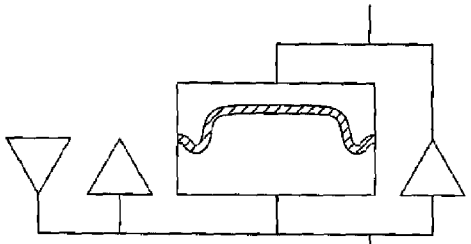
Figure 6D:
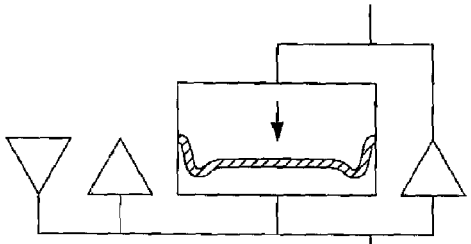
Figure 6E:
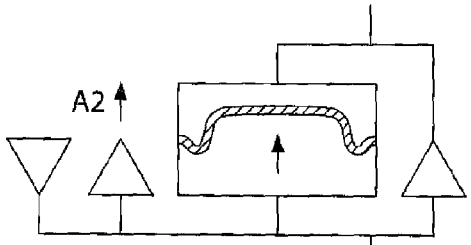
Figure 6F:
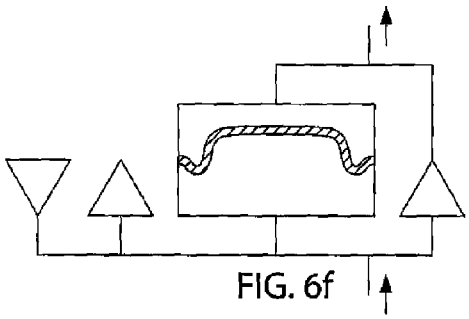

The situations shown in FIGS. 6*a*, 6*b* and 6*c* correspond exactly to those shown in FIGS. 4*a*, 4*b* and 4*c*. In FIG. 6*d*, the diaphragm 119" is shifted to its second position because of the volume of liquid being released to ambient air pressure through the open tap. This shift will cause an increase in the air pressure in the water conduit 7, 8, the pressure change or pulse being detected by the pressure sensor 15, 16 and causing the valve 11 or 12 to open, so that hot water is permitted to flow through the water conduit 7, 8 towards the valve device and the tap. The remaining air or gas in the conduit will be released through the air release valve part 116*b* (arrow A2 in FIG. 6*e*). When the hot water reaches the valve device, the air release valve 116*b* will close and the diaphragm 119" will be shifted to its first position. Also, the hot water will be permitted to flow through the liquid valve 118" to the water tap through the separate liquid passage and further to the water tap, possibly via a short length of pipe.

Figure 6G:
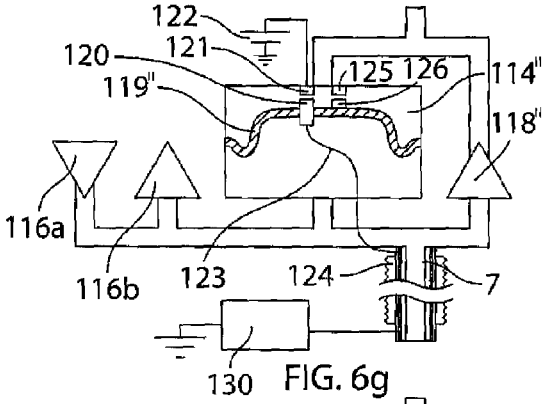

In the embodiment shown in FIG. 6*g*, the flexible diaphragm 19" is provided with a (movable) metal contact member 120, which will make contact with a fixed terminal member 121 being electrically connected to a voltage source 122, e.g. a DC battery or electric cell providing a voltage to the fixed terminal member 121. The metal contact member 120 on the flexible (and thus movable) diaphragm 119" is connected via a wire 123 to an electrically conducting layer 124 in the wall of the water conduit 7. Adjacent to the centrally located hot water source (2,22,6 in FIG. 1), the electrically conducting layer 124 is connected to a control unit 130. This control unit 130 will provide a voltage signal as long as the diaphragm 19" is located in its upper or first position (FIGS. 6*a*, 6*b*, 6*c*), i.e. as long as the hot water is flowing through the water tap 17 and the tap is open. A parallel pair of contact members 125,126 will ensure that the diaphragm 19" is kept at a ground or reference voltage level when the diaphragm is located in its first position.

When the water tap 17 is being closed (or deactivated by a sensor), the water pressure will immediately rise in the water conduit 7 so as to trigger the centrally located pressure sensor 15,16, whereupon the pump 5 will be activated and will suck out the hot water still remaining in the liquid conduit 7. Because of the incompressible volume of water between the closed water tap and the diaphragm 119" and the closed liquid check valve 118", the diaphragm 119" will remain in its first, upper position and continue to provide the voltage signal to the control unit 130. Air (or gas) will be sucked in through the gas inlet valve part 116*a* and will replace the water being pumped out from the conduit 7. After completion of the water evacuation process, the gas or air (at low pressure) will remain in the conduit until the water tap is activated again.

When the water tap is opened again (or activated by a sensor), the water pressure will build up in the liquid chamber 114" above the diaphragm 119", because of the ambient air pressure communicating through the open tap, and will release the diaphragm 119" to the second position (FIG. 6*d*). Then, the electric voltage signal will be cut off when the metal contact member 120 moves away from the fixed terminal member 121. This change will be detected by the control unit 130, which will trigger the second step of the refilling operation by opening the central valve 11, so that hot water is again supplied to the hot water conduit 7. The remaining air (or gas) will be let out through the air release valve part 116*b* until the hot water reaches the valve device. Then, the diaphragm 119" will be shifted again from its second or lower position into its first or upper position.

Thus, the embodiment of FIG. 6*g* operates in the same way as the previous embodiments, except that the signal from the valve device, indicating that the water tap has been activated and that hot water should be supplied through the hot water conduit 7, is provided as an electric signal along the conduit, from the water tap device to a central control unit.

Figure 6H:
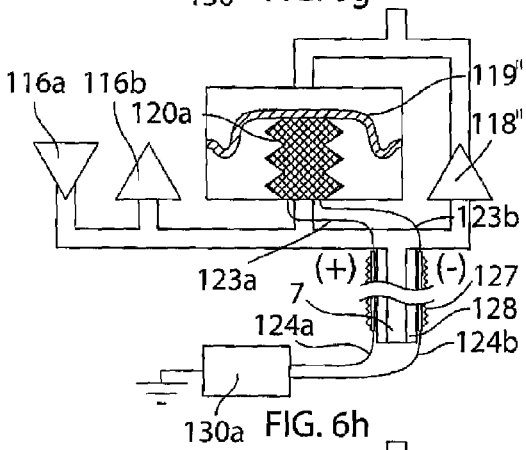

A further embodiment, similar to the one in FIG. 6*g*, is shown in FIG. 6*h*. Here, the signal is also an electric signal following the water conduit 7. In this case, there are two electrically conducting wires 124*a*, 124*b* (or coatings or layers) embedded inside an outer tube 127, e.g. a flexible plastic hose, but outside the wall 128 or the water conduit 7. The two wires 124*a*, 124*b* are connected, via wire portions 123*a*, 123*b*, to a flexible sensing body 120*a* arranged underneath the diaphragm 119". When the diaphragm moves downwardly, the flexible sensing body will change its electrical properties, e.g. its resistance, so that an electrical signal is received centrally in a receiver 130*a*, when the diaphragm moves from its first or upper position (as shown) into its second or lower position (corresponding to FIG. 6*d*).

Figure 6I:
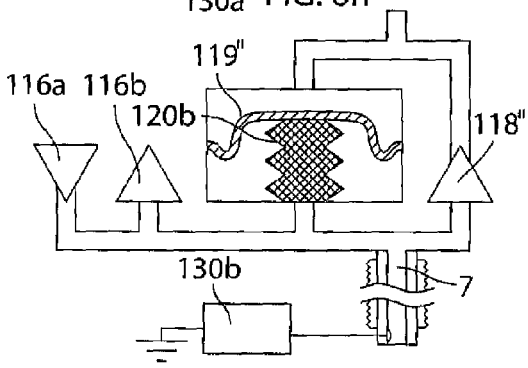

Another embodiment is illustrated in FIG. 6*i*, where an acoustic signal generator 120*b* is arranged under the diaphragm 119", this generator being accommodated in a flexible body and will be activated when the flexible body is compressed.

The acoustic signal, which is generated when the diaphragm 119" is moved from its upper or first position into its lower or second position, will propagate inside and along the water conduit 7. As in the previous embodiments, this happens when the water tap 9, 17 (FIGS. 1 and 7*a*), is being activated.

The acoustic signal will be detected by a centrally located acoustic sensor 130*b*, which will initiate the second step involving refilling the water conduit with water from the water source, while permitting remaining gas to escape via the air release valve part 116*b*.

Figure 7A:
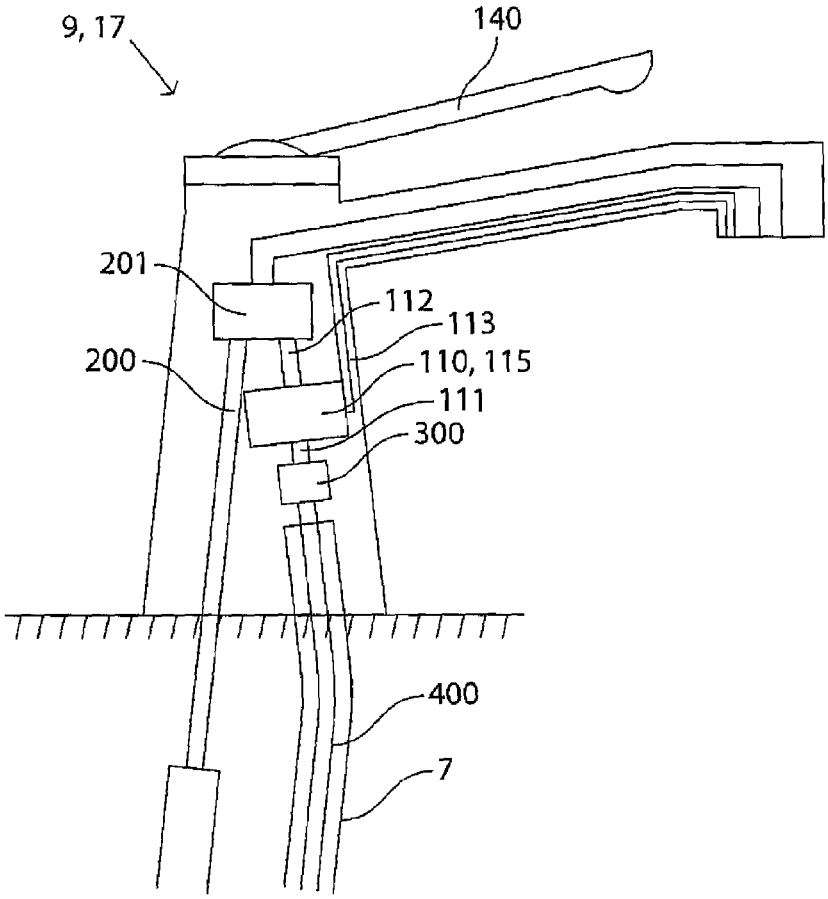
FIGS. 7*a*, 7*b*, 7*c* illustrate schematically a liquid tap device in a liquid distribution system according to the present invention.

In FIG. 7*a*, there is shown a possible structure of a water tap device, including an integrated valve device 110, 115 with its pipe connections 111, 112, 113, the latter being a separate air passage. There is also a cold water conduit 200 connected to a mixing device 201. Moreover, there is a flow control device 300 and a damping device 400 arranged between the end of the hot water conduit 7 and the valve device 110, 115.

Figure 8A:
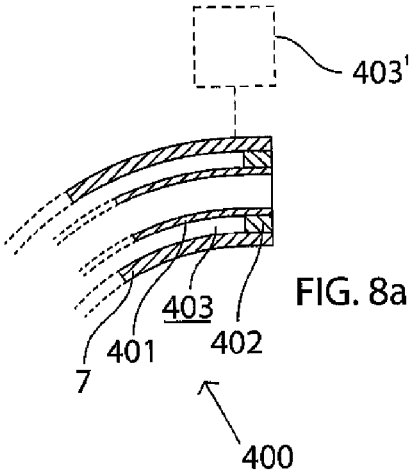
FIGS. 8*a*, 8*b*, 8*c*, 8*d*, 8*e* illustrate a damping device according to the invention and a flow control device being arranged in the liquid tap device of FIGS. 7*a*, 7*b* and 7*c*.
Figure 8B:
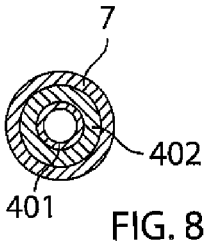
Figure 8C:
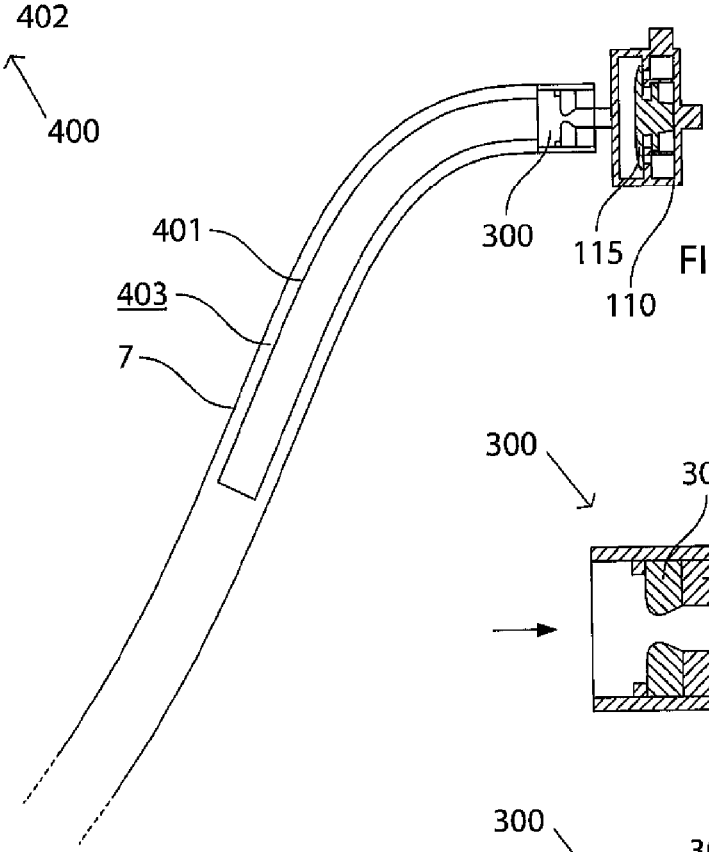

The damping device 400, according to the present invention, is shown in more detail in FIGS. 8*a*, 8*b* and 8*c*. It includes a smaller diameter inner pipe 401 extending inside the end portion of the water conduit 7, forming an annular volume inside the water conduit 7 and the outside of the inner pipe 401. At the end of the water conduit 7, there is an annular stop ring 402 of a durable material, sealing between the inner pipe 401 and the water conduit 7.

When water reaches the end portion of the water conduit 7 at a rather high velocity, at the final stage of a refilling operation, a volume of gas or air will be trapped in the annular chamber 403. In this way, this volume of air or gas will be compressed, and the high velocity movement of the water will be dampened. Accordingly, a sudden impact with an associated pressure peak and noise will be avoided.

As a further softening of the final impact of water at the valve device 110, 115, a flow control device 300 is inserted between the end of the water conduit 7 and the valve device 110, 115.

Figure 8D:
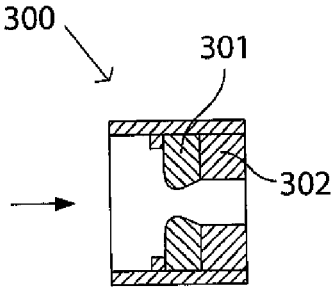
Figure 8E:
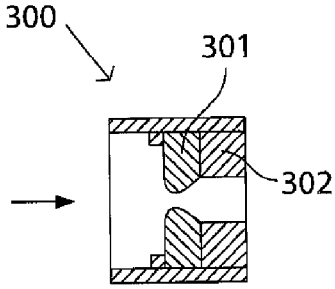

As illustrated in FIGS. 8*d* and 8*e*, the flow control device includes an elastic ring 301, supported at the downstream side by a fixed, rigid ring member 302. When the pressure increases, the elastic ring 301 will be compressed and deformed axially, thereby causing it to expand radially inwards, so that a smaller diameter axial passage will be formed, as shown in FIG. 8*e*. In this way, the flow of water will be reduced, since the free passage will be smaller.

The combination of a damping device 400 and the flow control device 300 will ensure a soft impact of the high velocity water at the final stage of a refilling operation.

Figure 7B:
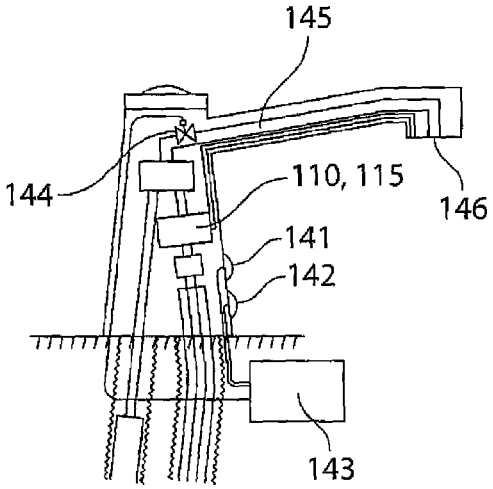
Figure 7C:
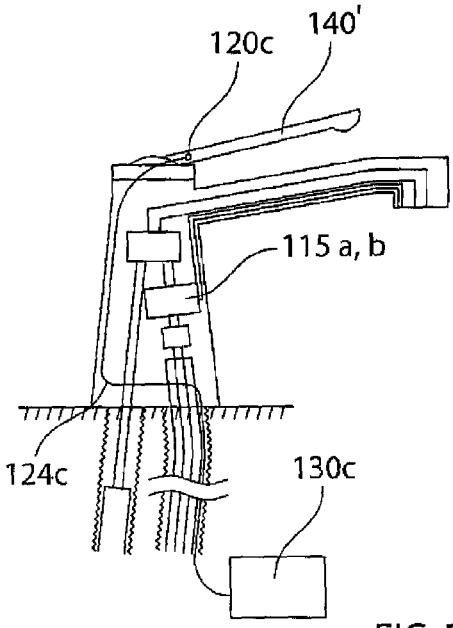

In FIGS. 7*b* and 7*c*, there are shown two modified embodiments of the actuator of the hot water tap 17. In FIG. 7*b*, the mechanical handle 140 (FIG. 7*a*), above the tapping pipe section, is replaced by an optical sensor, including one or preferably two optical sensor members 141, 142, which will remotely sense the presence of an object in front of the tap, e.g. a hand of a person wishing to wash his/her hands. The optical sensor members 141, 142 are connected to an electrical control device 143, which will operate (open or close) a valve 144 inserted in the pipe section 145 leading from the mixer 201 to the tap outlet 146.

The components 141 through 144 will operate just as the mechanical handle 140 of FIG. 7*a*.

In FIG. 7*c*, the water tap is provided with a handle 140' being provided with a touch sensor 120*c* which is connected via an electrical conductor 124*c* to centrally located control unit 130*c*. When the handle 140' is touched, moved or lifted, the control unit 130*c* will initiate the refilling operation in a similar manner as in the embodiment shown in FIG. 6*g* described above, i.e. in three consecutive steps (signal propagating back-wards, refilling of water in the water conduit, and permitting the water to flow out via the liquid passage to the water tap).

In the above specification, several embodiments of the valve device have been disclosed. For those skilled in the art, it is apparent that various modifications may be made, within the limits defined by the appended claims. For example, there may be two separate air passages, one for letting in gas or air and another one for letting out gas or air (as illustrated in FIGS. 6*a* through 6*i*).

As indicated above, there may be short length of piping between the liquid valve and the tap. Also, two or more taps may be connected, via short pipes, to a common liquid valve (as long as the total volume of liquid between the taps and the liquid valve is small).

An electric wire, such as the wires 124*a*, 125*b* in FIG. 6*g*, may be arranged on the outside of the protective outer tube 127. The important and advantageous feature is that the change or signal will propagate along the water conduit 7.

Moreover, the liquid tap device may comprise a mechanical coupling mechanism operating in the same way as the diaphragm.

Finally, a small gas container 113', containing pressurized gas, may be connected to the pipe connection 113 (FIGS. 3*a*, 4*a*) or the gas valve parts 116*a*, 116*b*, or the container may be constituted by the chamber 403, or else the chamber 403 may form a part of the gas passage to a small gas container 403'. Alternatively, the chamber 403 may constitute or replace the gas valve unit 110, 116. In any case, these alternative embodiments will form a closed system for the gas which will replace the liquid in the liquid conduit, when the liquid tap device is not in use.

The invention claimed is:

1. A method for retaining the temperature of a liquid in a liquid distribution system having at least one liquid conduit extending from a liquid source to a liquid tap, comprising the steps of:

evacuating the liquid from the liquid conduit after completion of a tapping operation, by generating a backward pressure gradient in said liquid conduit, causing the liquid to flow backwards towards said liquid source, while letting a gas flow into the liquid conduit and replace the backwardly flowing liquid therein, stopping said backward flow of liquid when the liquid conduit is evacuated, and evacuating the gas from the liquid conduit when liquid is to be tapped again from said liquid tap, by generating a forward pressure gradient in said liquid conduit causing the liquid to flow from said liquid source to said liquid tap, said step of evacuating the gas from the liquid conduit and refilling of liquid in said liquid conduit being performed in three steps:

a first step, initiated by said liquid tap being activated, the activation of the liquid tap causing a change of a physical variable, said change being sensed by a sensor so as to initiate a second step, said second step involving refilling the liquid conduit with liquid from said liquid source, while permitting remaining gas to escape via a gas passage being separate from a liquid passage in said liquid tap, and a third step, initiated when the liquid reaches said liquid tap, involving opening said liquid passage so as to permit liquid to flow out via said liquid passage and through said liquid tap, wherein at the end of said second step of refilling the liquid conduit with liquid from said liquid source, the motion of liquid will be dampened, when it approaches said at least one separate gas passage before said liquid passage is opened, by means of a compressible volume of gas communicating with said at least one separate gas passage and accommodating remaining air or gas being pushed in front of the liquid.

2. The method as defined in claim 1, wherein said physical variable is one of the following:

a gas pressure, said change being caused by letting the ambient air pressure communicate with the interior of the said liquid conduit upon said activation of said liquid tap, a varying gas pressure in the form of an acoustic signal generated in response to said activation of said liquid tap, and an electric signal being generated in response to said activation of said liquid tap.

3. A liquid distribution system comprising a liquid tap (9) and a valve device (17) connected to a liquid conduit extending from a source of liquid (2, 22, 6), said valve device comprising a liquid valve unit (118) for the passage of liquid through a liquid passage from said liquid conduit (7) to said liquid tap (9), and a gas valve unit (110, 116) being arranged in proximity to said liquid valve unit (118) for feeding gas into said liquid conduit in order to replace liquid with gas in said liquid conduit when the liquid tap is not in use, said gas valve unit (110, 116, 403) comprising at least one separate gas passage (113, 403) which is separate from said liquid passage (112), said gas valve unit (110, 116, 403) serving both as a gas inlet valve and as a gas outlet valve, said at least one separate gas passage (113, 403) being used both for feeding gas into the liquid conduit (7) after closing the liquid tap (9) and for letting gas escape from the liquid conduit when refilling the liquid conduit with liquid from said liquid source upon activating the liquid tap, and said valve device being adapted to enable said refilling of the liquid in three steps:

a first step, initiated by said liquid tap (9) being activated, the activation of the liquid tap causing a change of a physical variable, said change being sensed by a sensor (15, 16) so as to initiate a second step, said second step involving the generation of a forward pressure gradient and refilling the liquid conduit with liquid from said liquid source, while permitting remaining gas to escape via said at least one separate gas passage (113, 403), and a third step, initiated by said liquid reaching said gas valve unit (110, 116, 403), involving opening said liquid passage so as to permit liquid to flow out via said liquid passage (118, 112) and through said liquid tap (9), wherein a dampening device (400), including a compressible volume, which is located adjacent to the gas valve unit, and communicates with said separate gas passage so as to accommodate remaining air or gas being pushed in front of the liquid during a refilling operation, before said liquid passage is opened, whereby the motion of liquid will be dampened when it approaches the valve device during said refilling operation.

4. The liquid distribution system as defined in claim 3, wherein said sensor (15, 16) is centrally located.

5. The liquid distribution system as defined in claim 3, wherein said change of a physical variable involves a pressure increase being propagated along said liquid conduit, thereby initiating said second step involving the refilling of said liquid conduit with liquid.

6. The liquid distribution system as defined in claim 3, wherein said liquid valve unit is integrated with said gas valve unit, said liquid valve unit being a duck-bill type check valve.

7. The liquid distribution system as defined in claim 3, wherein said dampening device comprises an inner tubular body (401) disposed in an end portion of said liquid conduit (7), said compressible volume being formed by a gas or air volume inside or outside said tubular body.

8. The liquid distribution system as defined in claim 3, wherein a flow control device (300) is arranged adjacent to said valve device, said flow control device serving to limit the flow of liquid adjacent to the liquid tap.

9. The liquid distribution system as defined in claim 3, wherein said liquid valve unit and/or said gas valve unit are integrated in said liquid tap.

10. The liquid distribution system as defined in claim 3, wherein said gas valve unit forms a part of a closed gas system, said at least one gas passage (113) communicating with said compressible volume.

11. The liquid distribution system as defined in claim 10, wherein said at least one gas passage comprises an inlet passage (116*a*) and an outlet passage (116*b*).

12. The liquid distribution system as defined in claim 3, wherein said valve device comprises a flexible diaphragm (119, 119', 119") adapted to shift from a first position into a second position when the liquid tap is activated, under the influence of the ambient air pressure, said shift causing said change of a physical variable propagating backwards along said liquid conduit.

13. The liquid distribution system as defined in claim 12, wherein a liquid chamber is located between said liquid tap and said flexible diaphragm, a volume of liquid always being present in said liquid chamber.

14. The liquid distribution system as defined in claim 12, wherein the refilling of said liquid conduit with liquid will cause said flexible diaphragm to shift back into said first position, when the liquid reaches said valve device, thereby initiating said third step.

15. The liquid distribution system as defined in claim 3, wherein said valve device comprises a valve body (115) adapted to let in gas into the liquid conduit upon closing the liquid tap and to permit gas to escape from the liquid conduit when refilling the liquid conduit with liquid from said liquid source upon activating the liquid tap.

16. The liquid distribution system as defined in claim 15, wherein said valve body comprises a flexible annular portion (116) of an umbrella type.

17. The liquid distribution system as defined in claim 15, wherein said valve body is a single valve body forming a part (115) of said air valve unit as well as a part (118) of said liquid valve unit, and wherein said valve body comprises a holding portion (119) which is mounted in a valve housing.

18. The liquid distribution system as defined in claim 17, wherein said valve body comprises a flexible diaphragm (119) being movable between two different positions, a first position where a first portion (116) of said valve body abuts an air valve seat and serves as an inlet valve by flexing away from said air valve seat, and a second position where said first portion (116) of said valve device is located at a distance from said air valve seat, so as to permit an air-flow in both directions.

* * * * *